US008429799B2

(12) United States Patent
Ng

(10) Patent No.: US 8,429,799 B2
(45) Date of Patent: Apr. 30, 2013

(54) SEAT BELT BUCKLE

(75) Inventor: Wei-Loong Ng, Rochester, MI (US)

(73) Assignee: Key Safety Systems, Inc, Sterling Heights, MI (US)

( * ) Notice: Subject to any disclaimer, the term of this patent is extended or adjusted under 35 U.S.C. 154(b) by 180 days.

(21) Appl. No.: 12/975,674

(22) Filed: Dec. 22, 2010

(65) Prior Publication Data

US 2011/0146034 A1 Jun. 23, 2011

Related U.S. Application Data

(60) Provisional application No. 61/289,668, filed on Dec. 23, 2009.

(51) Int. Cl.
*B60R 22/48* (2006.01)
*A44B 11/25* (2006.01)

(52) U.S. Cl.
USPC ..... 24/641; 24/633; 24/640

(58) Field of Classification Search ..... 24/593.1, 24/625–642
See application file for complete search history.

(56) References Cited

U.S. PATENT DOCUMENTS

| | | | | |
|---|---|---|---|---|
| 4,733,444 | A * | 3/1988 | Takada | 24/641 |
| 5,054,171 | A * | 10/1991 | Tanaka | 24/637 |
| 5,159,732 | A * | 11/1992 | Burke | 24/641 |
| 5,280,669 | A * | 1/1994 | Nanbu et al. | 24/641 |
| 6,266,855 | B1 * | 7/2001 | Specht et al. | 24/633 |
| 6,370,742 | B1 * | 4/2002 | Yamaguchi et al. | 24/641 |
| 6,385,823 | B1 * | 5/2002 | Yamaguchi et al. | 24/641 |
| 6,427,297 | B1 * | 8/2002 | Yamaguchi et al. | 24/641 |
| 6,588,077 | B2 * | 7/2003 | Katsuyama et al. | 24/641 |
| 6,725,509 | B1 * | 4/2004 | Lee et al. | 24/641 |
| 6,746,048 | B2 * | 6/2004 | Tajima et al. | 280/801.1 |
| 7,124,480 | B2 * | 10/2006 | Kawai et al. | 24/633 |
| 2006/0290130 | A1 * | 12/2006 | Hall | 280/801.1 |

FOREIGN PATENT DOCUMENTS

| | | | |
|---|---|---|---|
| EP | 402839 | A2 * | 12/1990 |
| JP | 05278564 | A * | 10/1993 |
| JP | 2000318575 | A * | 11/2000 |
| JP | 2001080457 | A * | 3/2001 |

* cited by examiner

*Primary Examiner* — Robert J Sandy
*Assistant Examiner* — Louis Mercado
(74) *Attorney, Agent, or Firm* — Markell Seitzman; David L. King

(57) ABSTRACT

An improved seat belt buckle assembly (10) for use with a tongue (2) of a seat belt during use, locking the latch (20) and control lever (40) in the unlatched position, but when the buckle is latched and exposed to a rapid deceleration a mass (60) slides compressing a lower spring (52) into the frame (12) moving the mass (60) to occupy the space directly under stop surfaces (45) of control lever arms (42, 43) of a control lever (40) blocking downward movement and preventing a locking bar (18) from leaving a horizontal portion of L-shaped slots (9) preventing movement of the latch (20) into the unlatched position. The mass (60) is preferably attached to an ejector (30), the ejector (30) fits into a slot (62) in the mass (60) and extends into a pair of horizontal slots (31) on the frame, one horizontal slot (31) being on each vertical side (6, 7) of the frame (12). The ejector (30) secures the mass (60) in the frame (12) limiting the mass (60) to horizontal forward and rearward sliding movements.

14 Claims, 11 Drawing Sheets

SEAT BELT BUCKLE

This application claims the benefit of U.S. Provisional Application 61/289,668, filed on Dec. 23, 2009. The disclosure of the above application is incorporated herein by reference.

BACKGROUND AND SUMMARY OF THE INVENTION

This invention relates to a buckle for a seat belt, more specifically to an improved buckle design which provides superior impact resistances insuring the buckle remains latched during rapid changes in acceleration and deceleration.

Early seat belt buckle designs primarily were designed as a device to secure an occupant to prevent the occupant from impacting against the interior dash and steering wheel and to prevent ejection from the vehicle. Later designs of seat belt assembly employed more sophisticated seat belt retractors and pre-tensioning devices that could tighten a belt so as to securely and firmly pull the occupant against the seat back at the onset of a crash or even just prior to a crash event based on a sensed response to a rapid deceleration of a vehicle.

These added features created high acceleration and deceleration of the moveable components internal of the seat belt buckle assembly. Most seriously this inertia or momentum change could cause elements latching the tongue of the seat belt to the buckle to release, allowing the buckle under some circumstances to prematurely unlatch.

In U.S. Pat. No. 6,266,855 B1 a seat belt buckle was described which addressed this issue. This early attempt provided several solutions to the inertial movement of internal components and was a superior design to the buckles of that time.

The main disadvantage of this prior art design was the complexity of assembly and its requirement that the structural frame had to be made as a two-part assembly in order to properly secure the internal components. This added both to the design's complexity and cost.

The belt buckle of the present invention is a marked improvement in design eliminating these structural issues while providing a stronger yet less expensive assembly that provides secure locking of the latching mechanisms during occurrences of high inertial accelerations and decelerations, thus keeping the occupant secured in the seat belt harness.

In one embodiment, the inventions includes: an improved seat belt buckle assembly for use with a tongue of a seat belt, the seat belt buckle assembly has a frame; a latch attached to the frame which is moveable from a latched position to an unlatched position, a forward portion of the latch is configured to engage a portion of the tongue inserted into the frame as the latch moves into the latched position. A moveable control lever is positioned above the latch. The control lever is substantially U shaped, having a central portion with two lever arms extending from opposite ends of the central portion. The central portion of the control lever has a contact surface contacting an upper surface portion of the latch and a projecting tab extending from the central portion for receiving an upper spring. A locking bar is connected to the control lever and is moveable in L-shaped slots on each vertical side of the frame; wherein the latch is moved into engagement of the inserted tongue by an initial downward movement of the locking bar in the L-shaped slots followed by horizontal forward movement causing the control lever to pivot about the locking bar pushing the latch into a latched position. An upper spring urges the control lever and locking bar to push the latch downwardly into the latched position. An ejector is slidably mounted in the bottom of the frame for ejecting the tongue. The ejector is moveable in a horizontal direction within the frame. A mass is moveable with the ejector. A lower spring for biasing the ejector in an outward direction is connected to the frame and the mass. The lower spring compresses relative to the frame. When a release button which is slidably mounted onto the frame moves or pushes the locking bar in the L-shaped slots to unlatch the latch, and as the release button is depressed, the latch moves upwardly allowing the ejector and the mass to move forward, ejecting the tongue from the buckle. The control lever has stop surfaces on each end of the lever arms that move downwardly as the locking bar moves into a vertical portion of the L-shaped slots allowing the latch to move in the unlatched position, during normal use, locking the latch and control lever in the unlatched position, but when the buckle is latched and exposed to a rapid deceleration the mass slides compressing the lower spring into the frame moving the mass to occupy the space directly under the stop surfaces of the control lever arms of the control lever, blocking downward movement and preventing the locking bar from leaving a horizontal portion of the L-shaped slots, preventing movement of the latch into the unlatched position.

The upper spring is compressible between a rear fixed bracket attached to the frame and the tab of the control lever, wherein in the unlatched position the upper spring is compressed as the control lever rests on an upper surface of the latch when the locking bar is moved into the vertical portions of the L-shaped slot. The upper spring is held in place at each forward and rear end, the rear end held by a cylindrical projection concentrically inside the spring and the forward end held by the projecting tab on the control lever eccentrically holding the upper spring extending inside an upper portion of the upper spring and providing a downward force on the control lever and latch to assist movement in the L-shaped slot upon tongue insertion while allowing the upper spring to bend along a non linear path.

The mass is preferably attached to the ejector, the ejector fits into a slot in the mass and extends into a pair of horizontal slots on the frame, one horizontal slot being on each vertical side of the frame. The ejector secures the mass in the frame, limiting the mass to horizontal forward and rearward sliding movements.

BRIEF DESCRIPTION OF THE DRAWINGS

The invention will be described by way of example and with reference to the accompanying drawings in which.

DETAILED DESCRIPTION OF THE INVENTION

Figure 1:
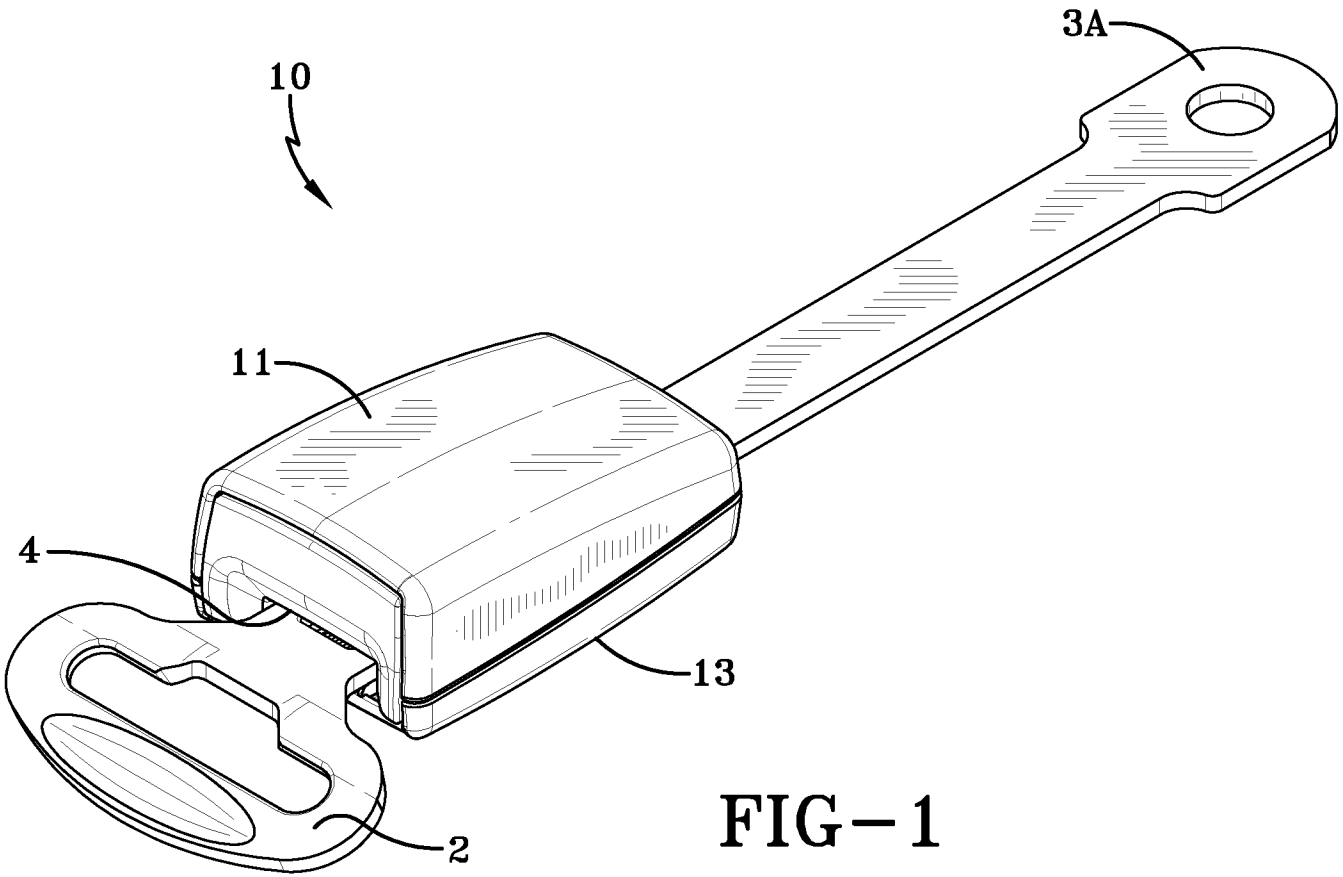
FIG. 1 is a perspective view of the seat belt buckle according to the present invention.
Figure 2:
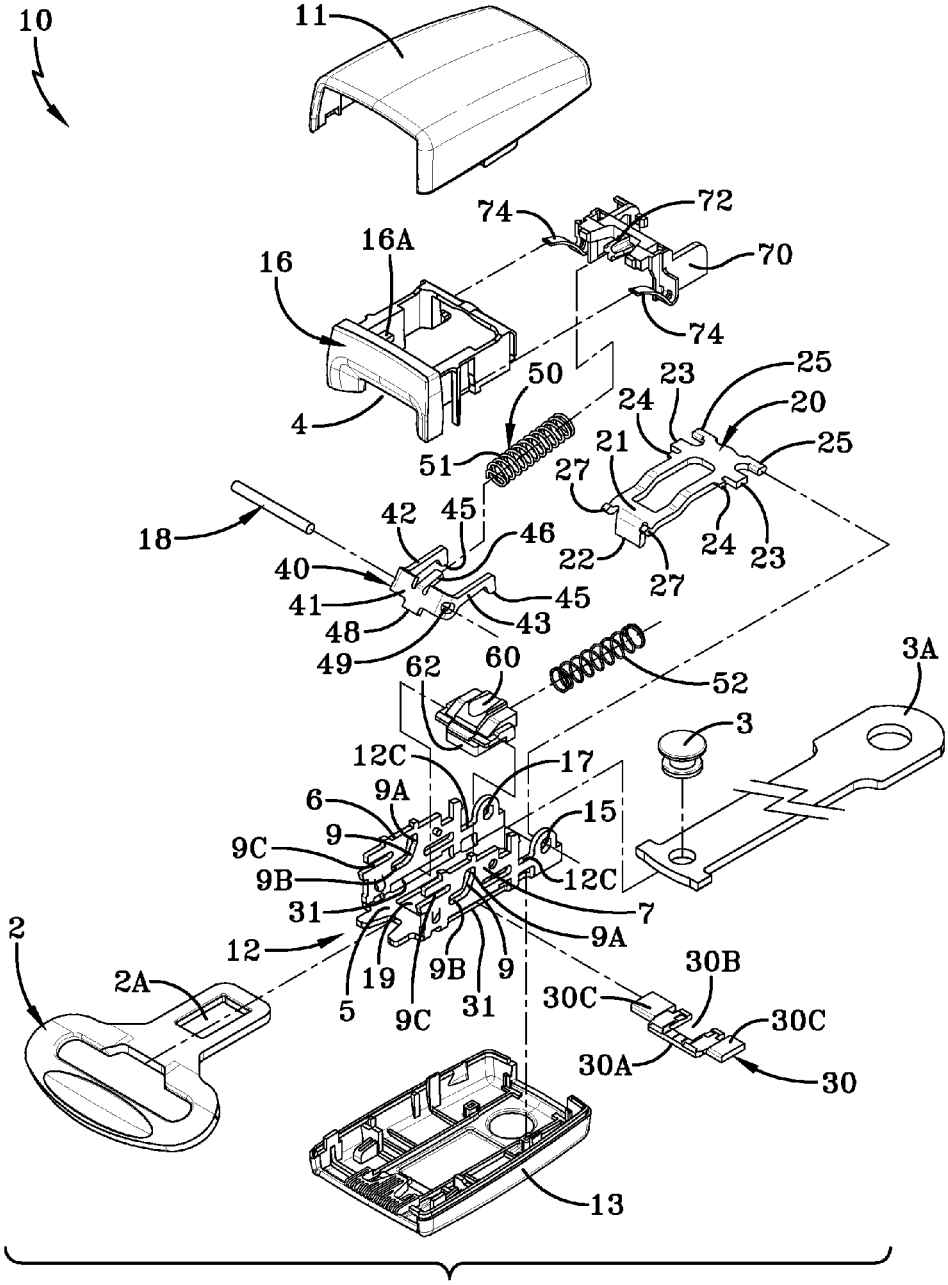
FIG. 2 is an exploded view of the seat belt buckle showing the various components used in the assembly.
Figure 2A:
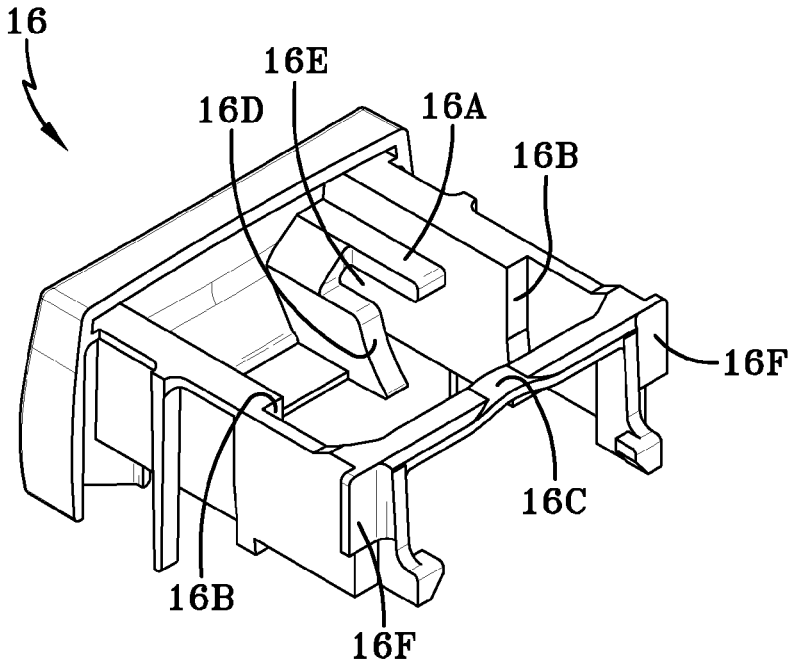
Figure 2B:
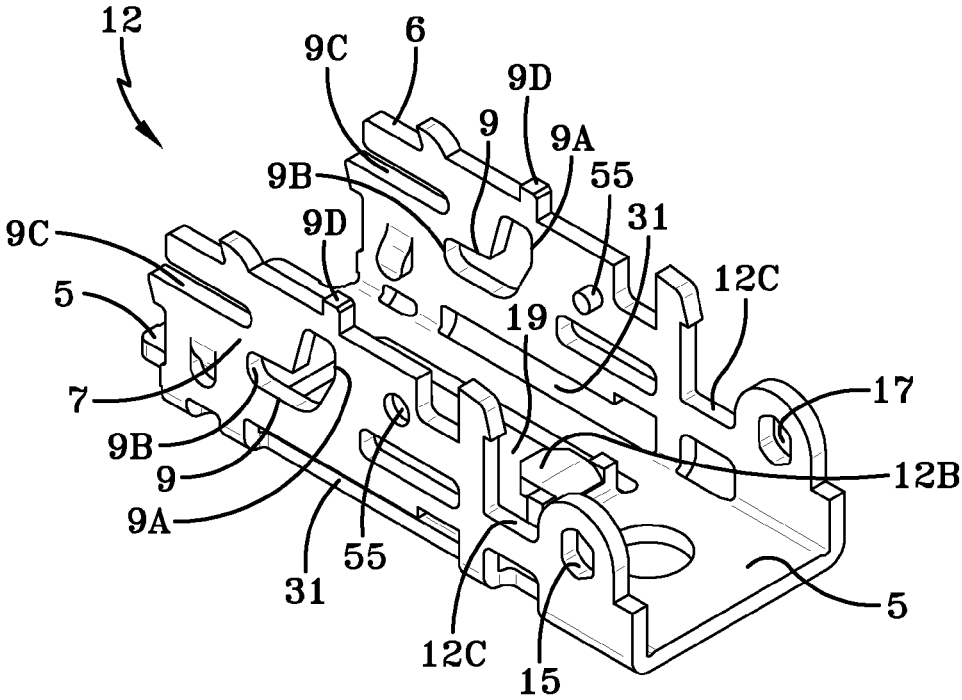

With reference to FIGS. 1-7A, a buckle assembly 10 according to the present invention is shown. The buckle assembly 10 has an upper cover 11 and lower cover 13 as illustrated in FIGS. 1 and 2. The forward end of the buckle assembly 10 has a slot 4 for accepting a tongue 2 of a seat belt in order to latch the buckle assembly 10 to the tongue 2 in order to secure an occupant of a vehicle seat. The opposite end of the buckle assembly 10 provides an attachment rivet 3 for securing a seat belt strap connector 3A to the buckle assembly 10. As further shown in the exploded view of FIG. 2, the buckle assembly 10 with the covers 11 and 13 removed exposes the internal components of the buckle assembly 10.

Figure 6A:
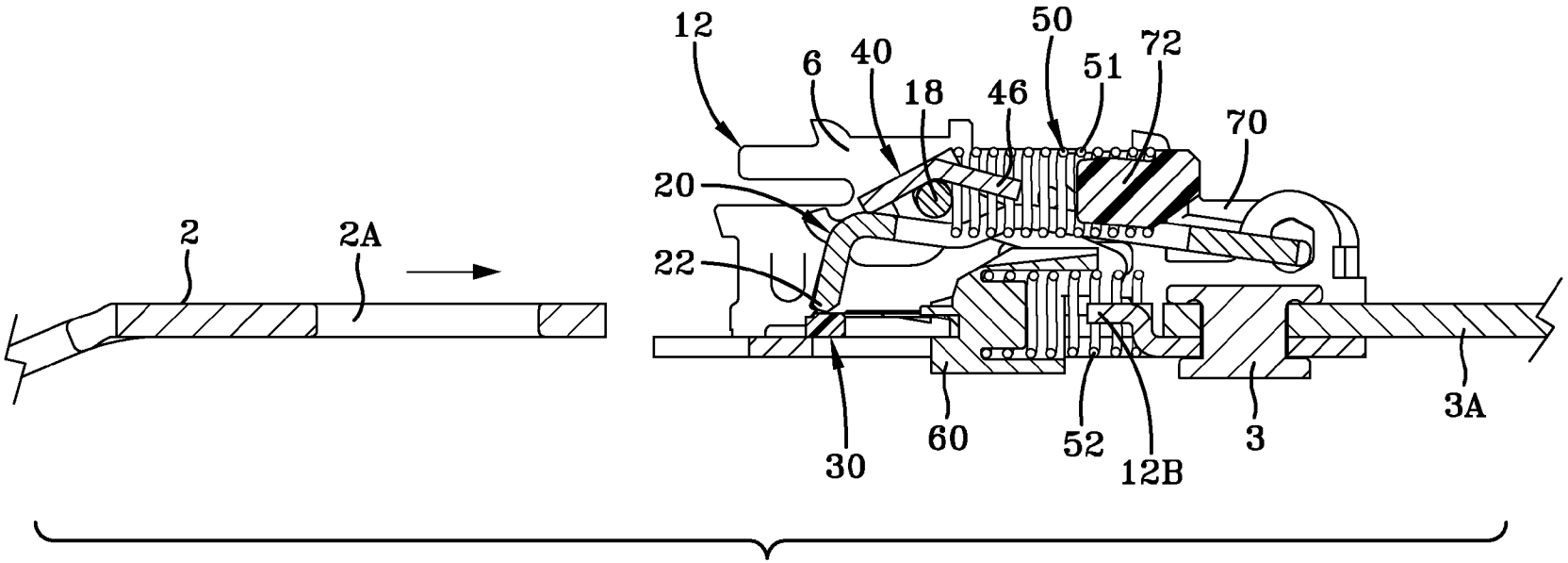
FIGS. 6A, 6B and 6C are side cross-sectional views of the seat belt buckle showing the various positions of unlatched, latched and exposed to rapid deceleration, respectively.
Figure 6B:
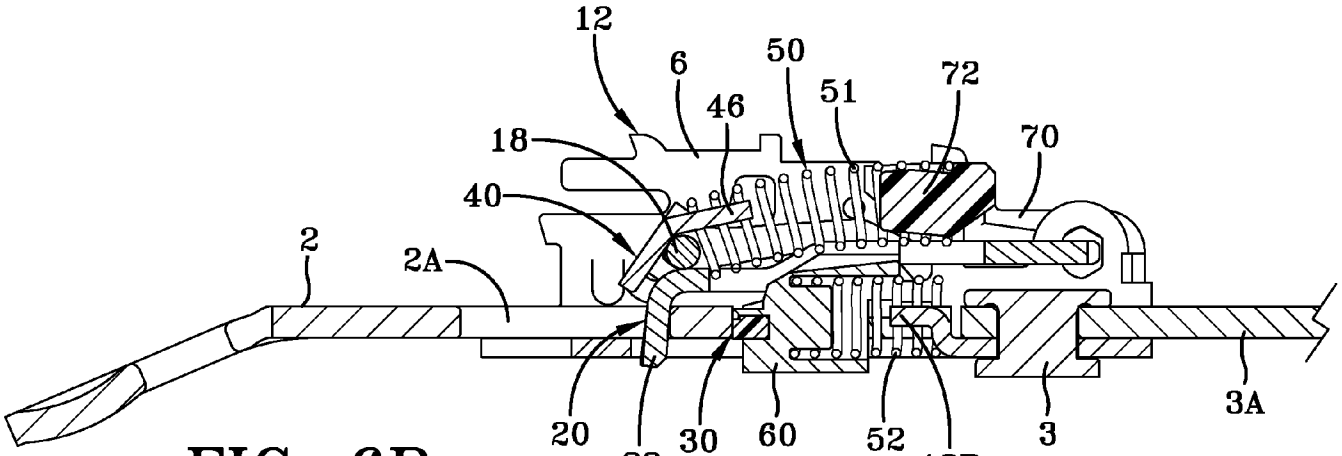

The buckle assembly 10 includes a frame 12 which is configured as a one-piece construction having a bottom base 5 and two vertical sides 6, 7 extending from the bottom of base 5 vertically upwardly as illustrated in FIG. 2. A latch 20 is shown wherein the latch 20 is configured to be assembled as secured to the frame 12 through openings 15, 17 in the vertical sides 6, 7 of the frame 12. The latch 20 extends forward having an upper surface 21 that extends towards a large opening 19 in the base 5 of the frame 12 which allows a locking projection 22 extending from the latch 20 to move into the large opening 19 in the frame 12 in the latched position. As shown the latch 20 has pairs of projections 23, 25 extending from each side. The most rearward pair of projections 25 is configured to be inserted into openings 15, 17 in the rear of the frame 12 and are allowed to pivot within the openings 15, 17 allowing the latch 20 to move about the pivot in an upward and downward direction relative to the frame 12. Ahead of the rearward projections 25 are a pair of intermediate projections 23 which extend over cutouts or slots 12C in the frame 12 and are allowed to contact and stop on the slots 12C on the vertical sides 6, 7 of the frame 12 in order to limit the amount of movement that the latch 20 can pivot such that the projections 23 stop the latch 20 from further downward motion during the pivoting action. Directly ahead of the intermediate projections 23 are two small guide projections 24 extending outwardly. These small guide projections 24 are positioned internal of the sides 6, 7 of the frame 12 when the latch 20 is assembled to the frame 12. The guide projections 24 limit the amount of twist that can be put on the latch 20. These small guide projections 24 move upwardly and downwardly within the frame 12 as the latch 20 pivots and limit the amount of twist or sideways movement that can be put on the latch 20. The latch 20, as illustrated in FIGS. 3, 4, 7A and 7B, is configured such that it can move from an unlatched position to a latched position when a tongue 2 of a seat belt buckle assembly 10 is inserted into the buckle assembly 10. As the tongue 2 is inserted into the slot 4 of the buckle assembly 10 the latch 20 is to move downward to a latched position. A U shaped control lever 40 is mounted directly above the latch 20. The U shaped control lever 40 has a central portion 41 and a pair of extending lever arms 42, 43 that extend from the central portion 41 on each side towards the rear portion of the buckle assembly 10. The rearward extending lever arms 42, 43 terminate at stop surfaces 45, the stop surfaces 45 are slightly curved and allow the control lever 40 to pivot as the latch 20 moves vertically upwardly and downwardly. The central portion 41 of the control lever 40 includes a rearward projecting tab 46 adapted to hold an upper spring 50. This rearward projecting tab 46 is inserted into one end of the spring 50 and is configured in such a fashion that it contacts the inside upper coils 51 of the spring 50 when assembled. Directly below and centered on the control lever 40 is a contacting surface 48 which slides over an upper surface 21 of the latch 20. This contacting surface 48 in the unlatched position rests on the upper surface 21 of the latch 20 and provides a constant downward force as a result of the compression of the spring 50 during the unlatched position. This constant force provides an excellent means of avoiding rattling and noise generation of these components. As the tongue 2 is inserted into the buckle assembly 10 it pushes an ejector 30 rearwardly. The latch 20 which had the locking projection 22 resting on the ejector 30 is now free to move downwardly to engage the tongue 2. As the latch 20 pivots downwardly the control lever 40 moves forward. The control lever 40 is secured to the frame 12 by a locking bar 18. The locking bar 18 is mounted to the frame 12 on each vertical side 6, 7 through an L-shaped slot 9 on each side. This L-shaped slot 9 has a substantially vertical portion 9A and a substantially horizontal portion 9B. The vertical portion 9A is towards the rear of the frame 12 and the horizontal 9B portion extends forward from the lowest part of the vertical portion 9A towards the buckle opening or slot 4 where the tongue 2 is inserted. This L-shaped slot 9 provides a guide for the locking bar 18 to move which enables it to move initially vertically downwardly and then horizontally forward as the latch 20 engages the tongue 2 of the buckle assembly 10. As shown in FIGS. 4, 6B and 7B, the locking bar 18 presses against the upper surface 21 of the latch 20 holding it in the latched position. A push release button 16 is provided which enables the buckle assembly 10 to be unlatched from the latched position. The push release button 16 mounts over the external surface of the frame 12 along the vertical sides 6, 7 and includes a pair of forward projections 16A that enable the latch 20 to be moved from its latched position to the unlatched position by pushing on the locking bar 18 horizontally backward and then upward in the L-shaped slot 9 while simultaneously moving the control lever 40 back and upward and enabling the latch 20 to release from the latched position to the unlatched position. Directly under and in the large opening 19 of the frame 12 is provided an ejector 30 which is moved by a lower spring 52 which enables the ejector 30 to slide in horizontal slots 31 provided in the frame 12. These horizontal slots 31 limit the movement of the ejector 30 in a horizontal direction and when the push release button 16 is pushed, the ejector 30 under a spring load or force of the lower spring 52 outwardly drives the tongue 2 to eject or release from the buckle assembly 10. The ejector 30 has a leading surface 30A that contacts the tongue 2 and upon which the locking projection 22 of the latch 20 can move onto and sit in the unlatched position. As shown a mass 60 is assembled to the ejector 30 during assembly of the frame 12 of the buckle assembly 10. The mass 60 is placed in the frame 12 in the large opening 19 and then the ejector 30 is slid through the horizontal slots 31 in the frame 12 and affixed to the mass 60 in such a fashion that the mass 60 and the ejector 30 operate as a unit. The ejector 30 has a U shaped opening 30B which fits tightly into a corresponding three-sided groove 62 on the mass 60. The mass 60, which will be discussed later, provides additional force, inertia, mass or responsiveness to accelerations and decelerations commonly referred to as G forces.

On a rearward portion of the frame 12 is an upper bracket 70 of molded plastic; this upper bracket 70 provides a cylindrical projection 72 for holding the upper spring 50 concentrically in the aft location of the frame 12. This upper bracket 70 further includes a pair of integral spring arms 74 which enable the push release button 16 to be oriented or biased towards the forward portion of the buckle assembly 10 during normal use. The lower spring 52 is mounted directly to the mass 60 and to a projection 12B on the lower portion of the frame 12; this enables the ejector 30 to be moved in an aft direction in the latched position.

Figure 3:
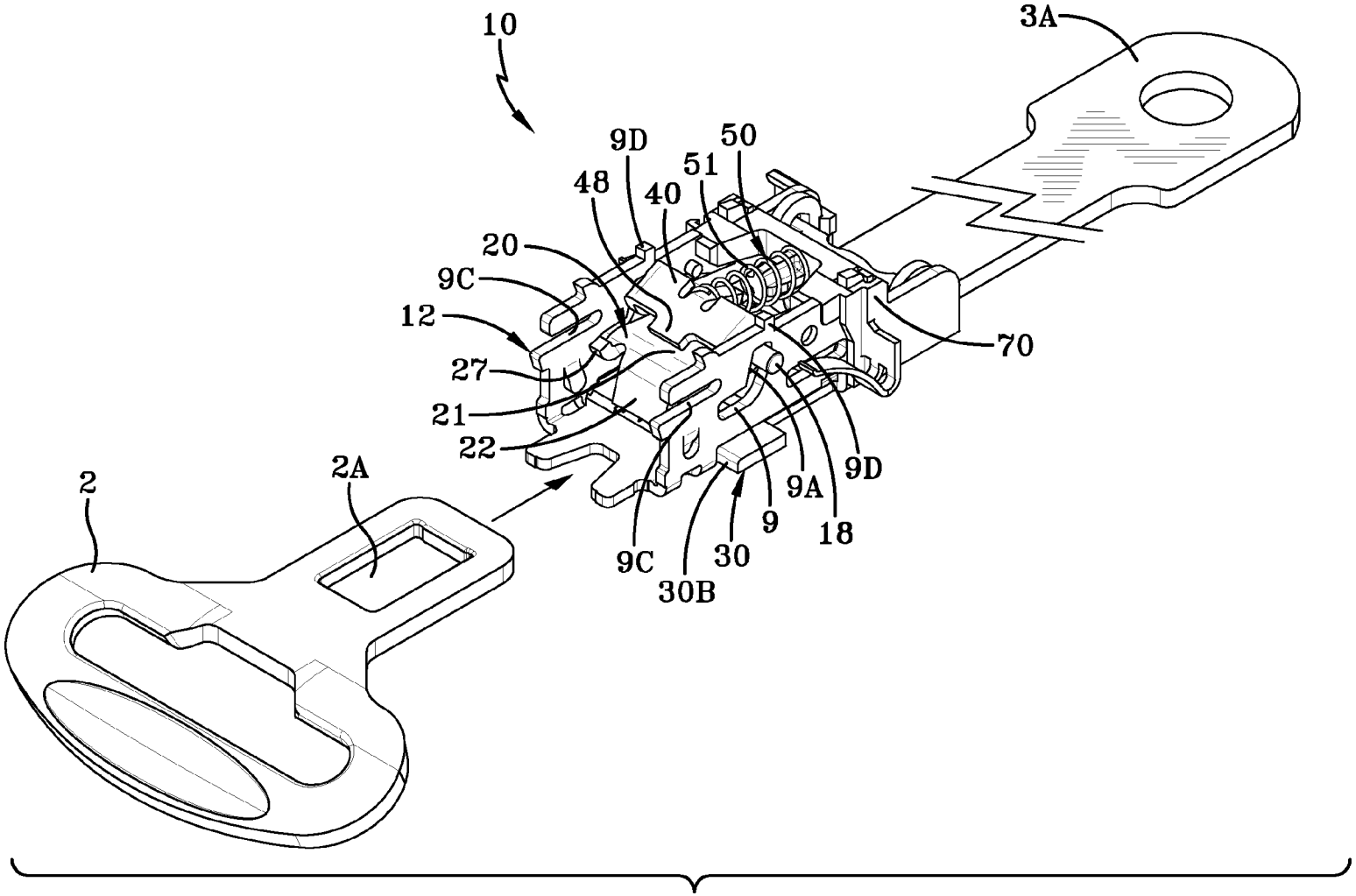
FIG. 3 is a perspective view of the seat belt buckle with the outer covers removed exposing the internal components in the unlatched position.
Figure 4:
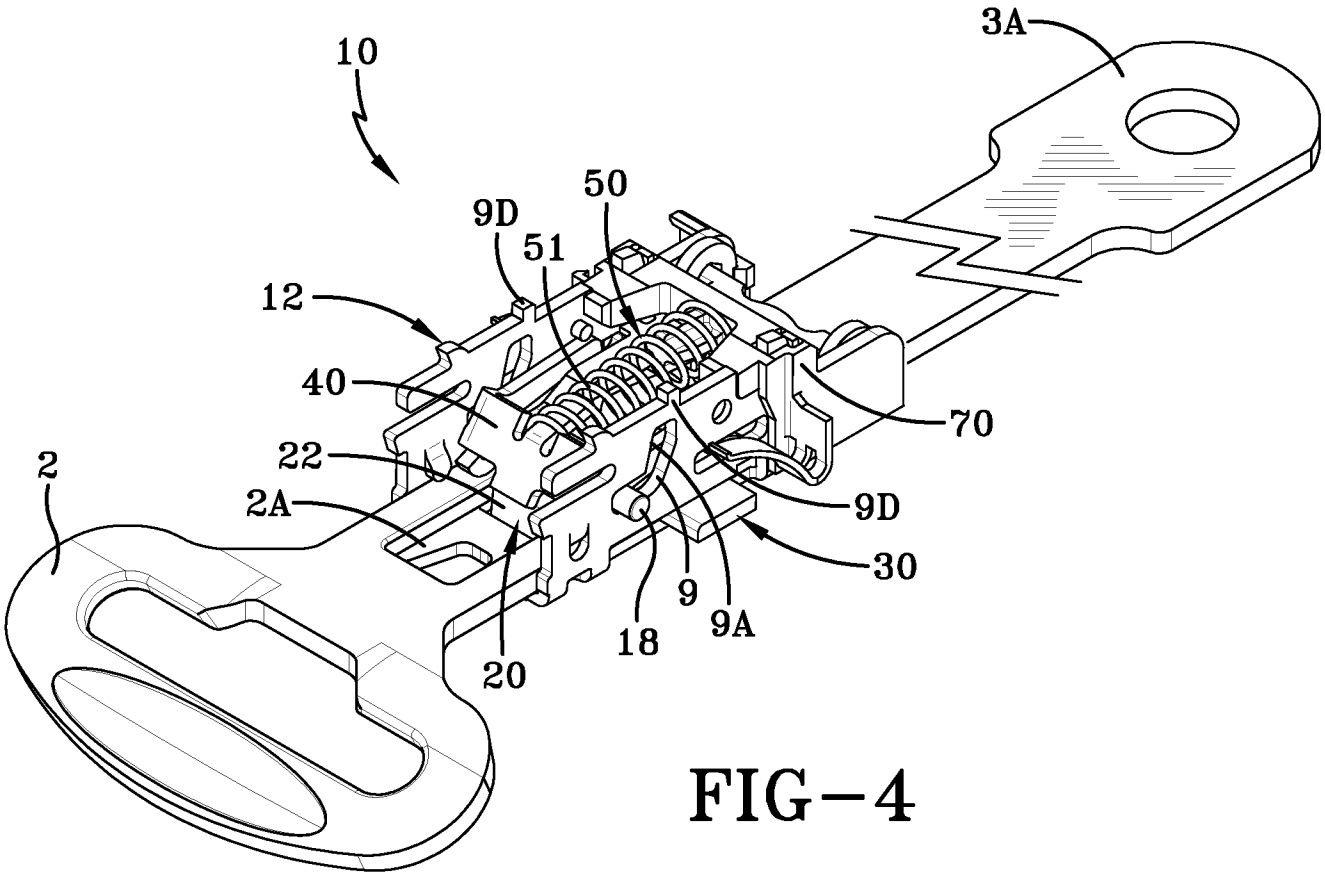
FIG. 4 is the perspective view of the seat belt buckle of FIG. 3 shown in the normal latched position with the seat belt tongue inserted.
Figure 7A:
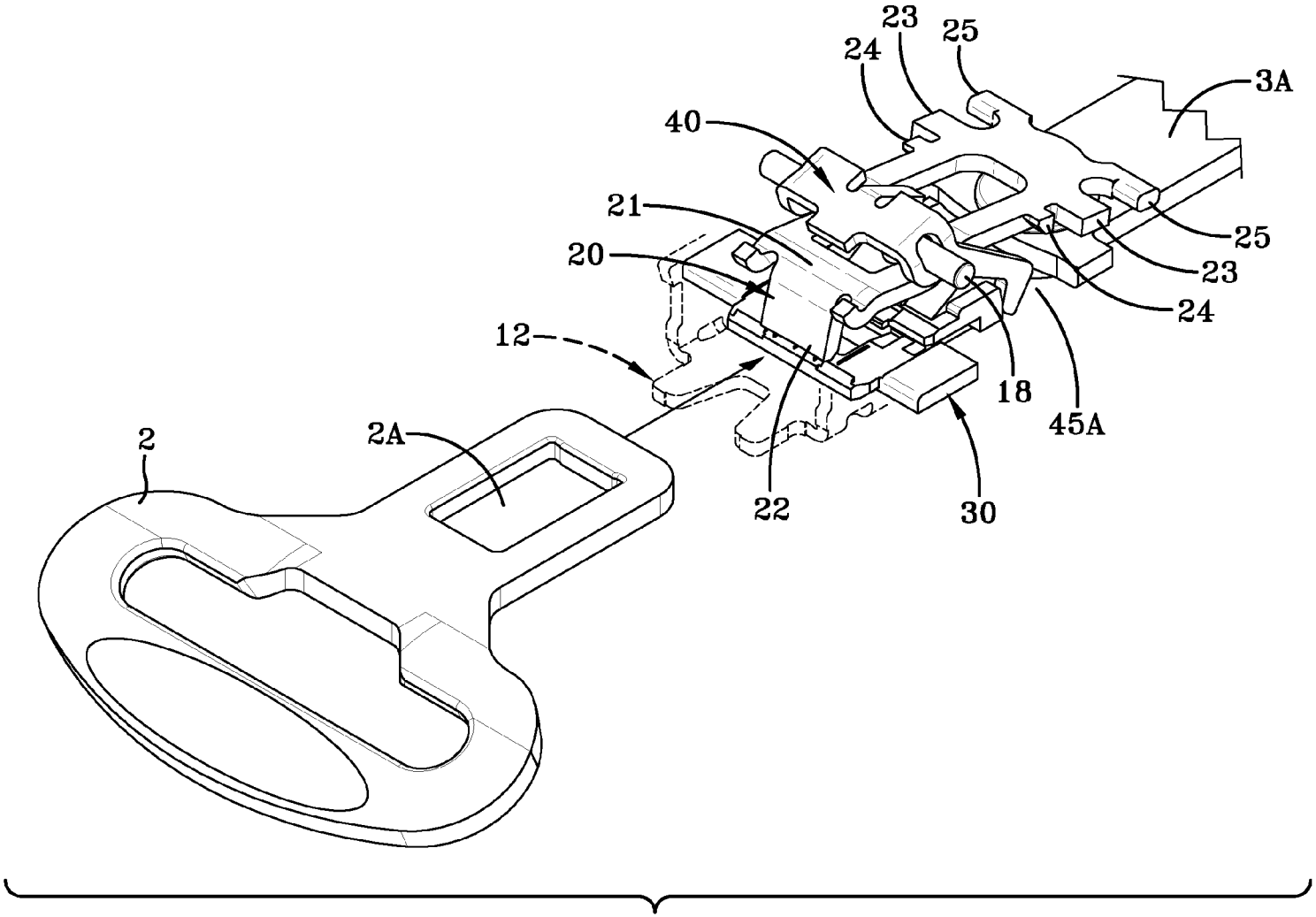
FIGS. 7A, 7B and 7C illustrate movement of various internal components of the buckle.
Figure 7B:
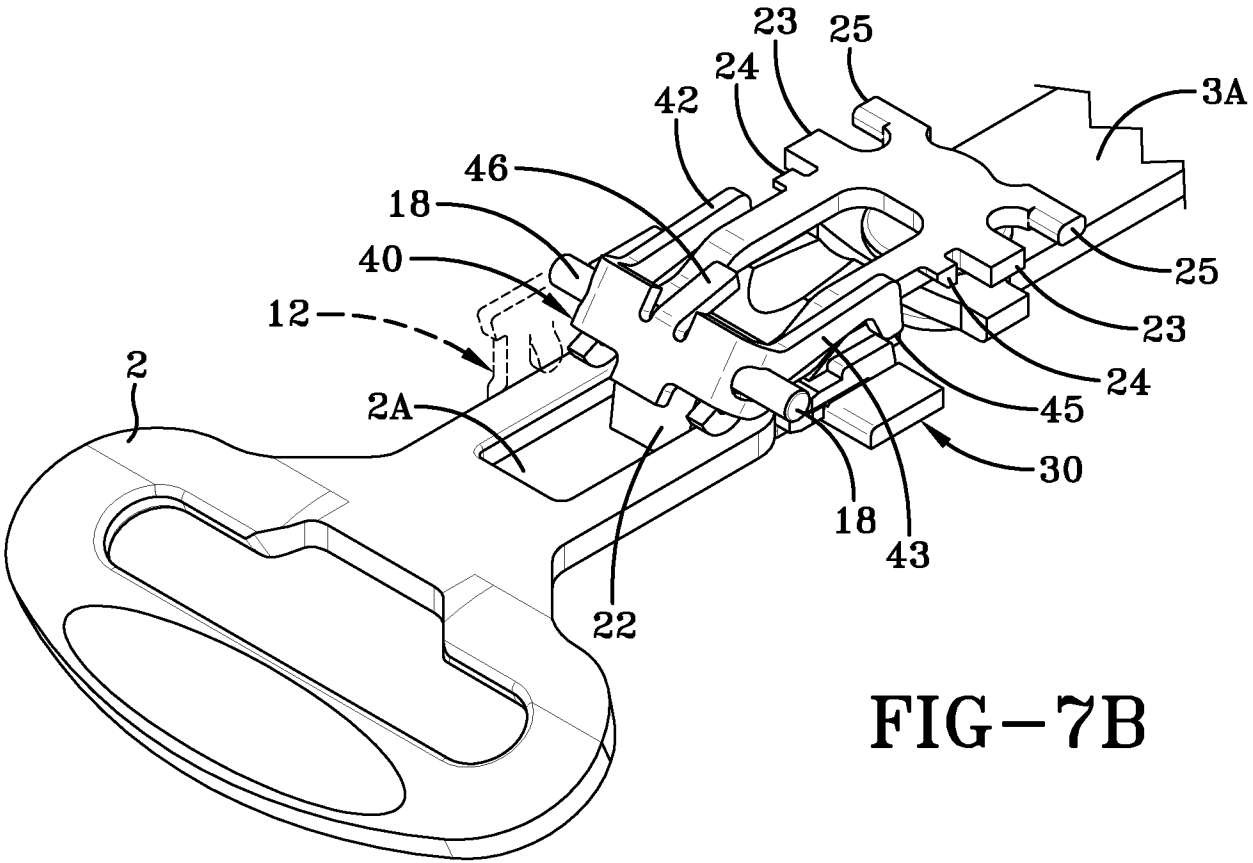
Figure 7C:
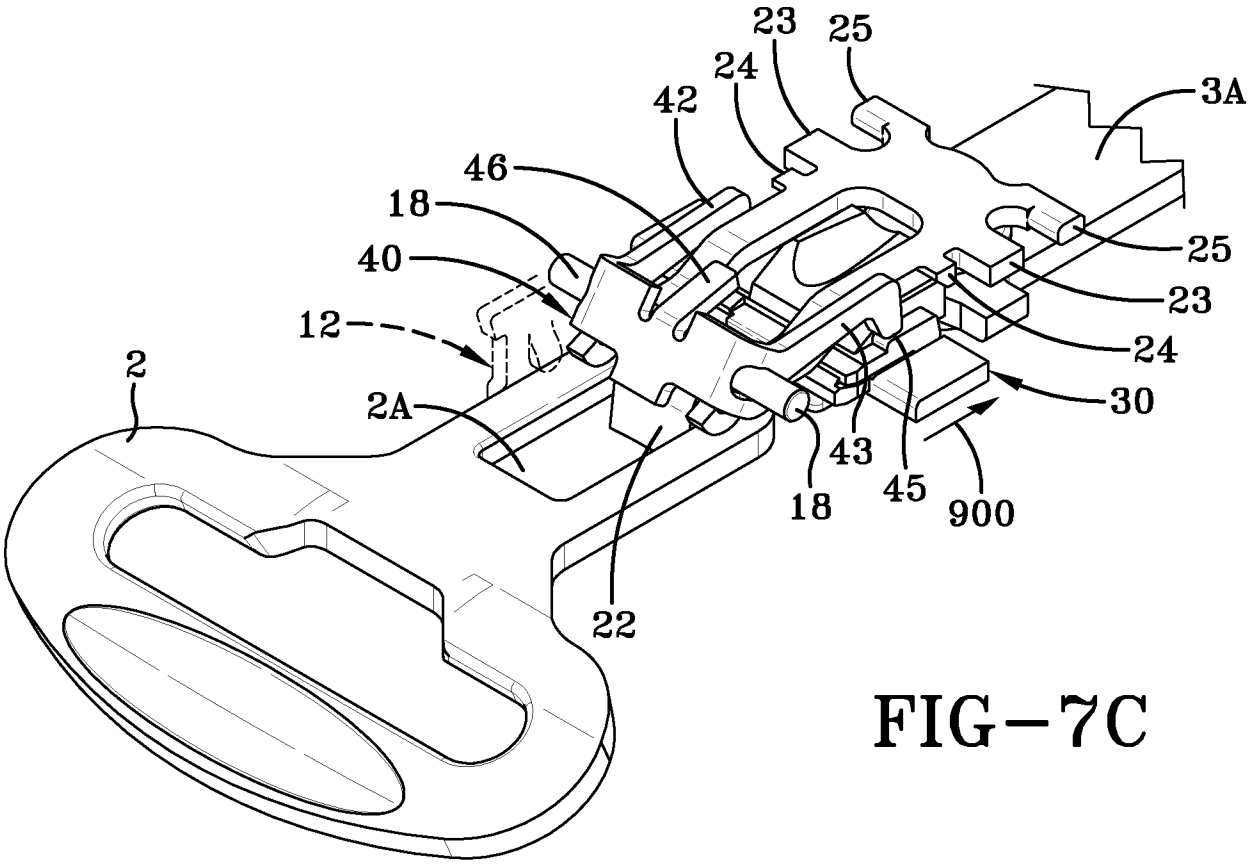

With reference to FIGS. 3, 4, 5, 7A, 7B and 7C, various perspective views of the buckle assembly 10 are shown. In FIGS. 7A, 7B and 7C, portions of the frame are removed to better show how the movements of the internal components work during unlatching, latching and rapid decelerations. In FIGS. 3 and 7A, the tongue 2 has not been inserted into the buckle assembly 10 which is shown in the unlatched position. In the unlatched position the upper spring 50 is shown in a compressed mode with the control lever 40 riding on the upper surface 21 of the latch 20; in this condition the mass 60 and the ejector 30 are fully forward relative to the frame 12 and occupy the most forward portion of the large opening 19 in which the mass 60 slides. The latch 20 locking projection 22 sits on top of the ejector 30 in the unlatched position and the locking bar 18 is in the upper vertical portion 9A of the L-shaped slots 9 with the control lever 40 resting on the upper surface 21 of the latch 20. In FIG. 4, upon insertion of the tongue 2, the ejector 30 is pushed rearwardly as the locking projection 22 of latch 20 engages the tongue 2 dropping into a tongue opening 2A. The control lever 40 is moved and guided by the locking bar 18 movement in the L-shaped slots 9 wherein the upper spring 50 assists in the forward movement by driving the control lever 40 vertically downward and forward as the ejector 30 and mass 60 are moved backward exposing the forward portion of the large opening 19 in the bottom of the frame 12. This enables the latch 20 locking projection 22 to drop securely into the opening 2A and be inserted in the tongue opening 2A in the tongue 2, thus securing the tongue 2 to the buckle assembly 10 as shown. This is a latched position as illustrated in FIGS. 4, 6B and 7B.

For normal unlatching of the seat belt buckle 10 to occur the mass 60 and the ejector 30 are positioned sufficiently forward allowing the lever arms 42, 43 of the control lever 40 to pivot about the locking bar 18 over the mass 60 into openings in the frame 12 as the tongue 2 is removed when the push release button 16 is depressed. This pivoting allows the stop surfaces 45, which project downwardly from the lever arms 42, to rotate into these otherwise unoccupied spaces, allowing the front end of the control lever 40 to pivot upwardly as guided by the locking bar 18 in the L-shaped slots 9, moving into the upper vertical portions 9A as the stop surfaces 45 of the lever arms 42 move downwardly in the rear portion of the frame 12. The lower spring 52 pushes the ejector 30 and mass 60 forcing the ejector into the locking projection 22, pushing the latch 20 upwardly and the projection 22 onto the ejector 30 as illustrated. This is the unlatched position illustrated in FIGS. 3, 6A and 7A.

Figure 5:
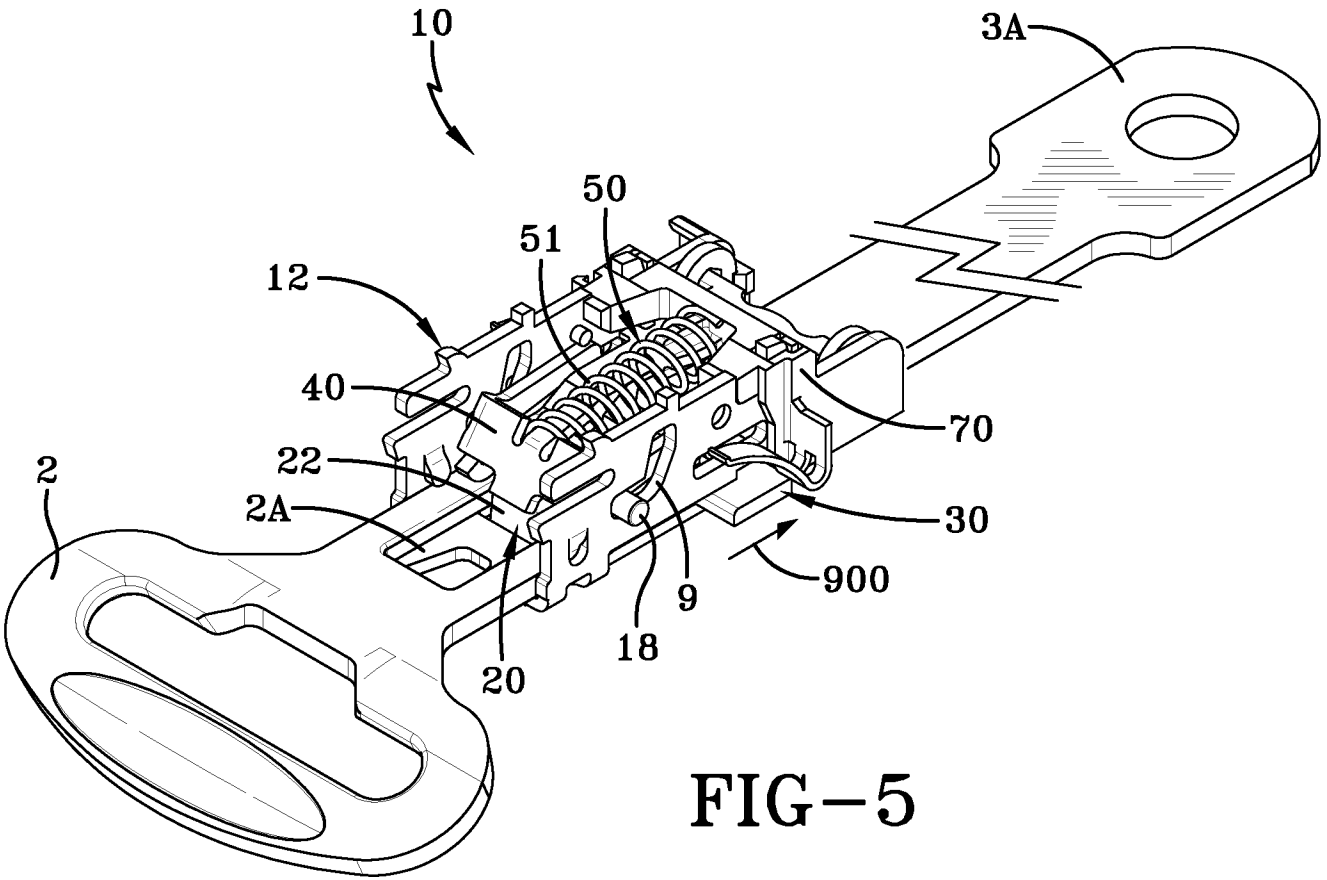
FIG. 5 is the seat belt buckle of FIG. 4 shown in perspective view wherein the buckle has been acted on by a rapid deceleration as typically occurs when coming to an abrupt stop after exposure to an activated pretensioner pyrotechnic device.
Figure 6C:
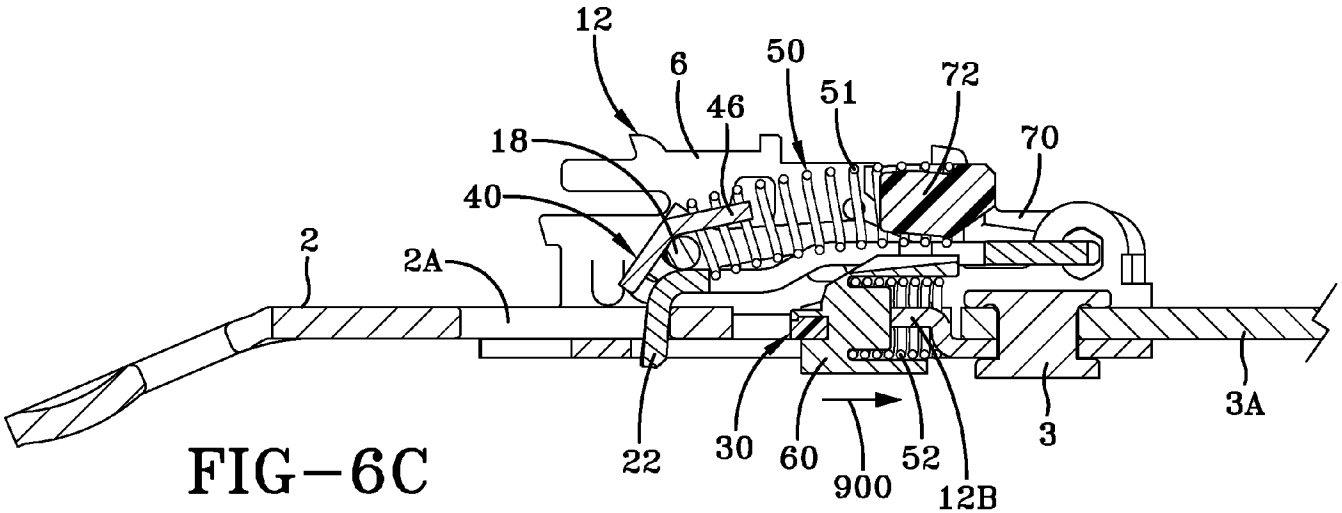

In FIGS. 5, 6C and 7C a simulated situation where the buckle assembly 10 has been acted upon by a pyrotechnic device (not illustrated) creating a tremendous acceleration of the internal components as the buckle is moved by the pyrotechnic pretensioner pulling on the buckle assembly tightening the seat belt about the occupant. As the seat belt assembly is tightened, the buckle assembly 10 will come to an abrupt stop. As this stop occurs a rapid deceleration of the buckle assembly 10 occurs, however due to the movement to the deceleration forces exerted on the internal components of the buckle assembly 10, the mass 60 will move in a rearward direction along with the ejector 30 compressing the lower spring 52, most easily seen in FIG. 6C. The mass 60 has a weight sufficient to overcome the compressive spring force of the lower spring 52 and is preferably made of a heavy alloy of zinc or similar metal. As this deceleration movement occurs the push release button 16 moves towards the depressed state, but cannot unlatch the tongue 2 of the seat belt buckle assembly 10. This is due to the fact that the mass 60 moving under the inertial forces compresses the lower spring 52 and moves into a location where it slides rearwardly in horizontal slots 31 in the frame 12 a distance sufficient to block the control lever arms 42, 43, stop surfaces 45 against the upper surface of the mass 60, preventing the control lever 40 from pivoting upwardly as depicted most accurately in FIG. 7C. When this occurs a depression of the push release button 16 cannot cause the tongue 2 to be ejected or unlatched because the mass 60 is preventing downward movement of the control lever arms 42, 43 to the unlatched position. As a result, the locking bar 18 affixed to the control lever 40 cannot move from the horizontal portions 9B of the L-shaped slots 9 making it impossible to unlatch the tongue 2.

With reference to FIGS. 6A, 6B and 6C side cross-sectional views of the buckle assembly 10 in the unlatched, latched and deceleration mode are shown illustrating the movement of the mass 60 relative to the frame 12.

As can be easily appreciated the present design provides a unique way of activating the control lever 40 in such a fashion that the upper spring 50 is concentrically loaded on a rear portion and yet eccentrically loaded on a forward portion by a projecting tab 46 which provides an ability for the upper spring 50 to rotate as the control lever 40 attached to the locking bar 18 is moved as the locking bar 18 passed through the L-shaped slots 9 in such a fashion that the upper spring 50 provides an assistance or downward force on the control lever 40 tending to assist in driving the locking bar 18 against the latch 20 in the latching of the buckle assembly 10 to the tongue 2. As illustrated in the latched position the tab 46 is contacting the inside upper surfaces of the coils 51 of the upper spring 50 in such a fashion that the spring 50 is allowed to bend over the latch 20 and provide a downward force. In both the unlatched and latched positions this upper spring 50, by providing a downward force on the control lever 40 against the latch 20, ensures that the components cannot rattle during normal use. This eliminates a source of noise that could otherwise be generated by the buckle assembly 10.

A further beneficial aspect of the buckle assembly 10 according to the present invention is that the mass 60 used to be responsive to inertial forces and rapid accelerations and decelerations has been affixed to the ejector 30 in such a fashion that these two components are rigidly attached together upon assembly. This enables these two components to operate as one and provides no ability to generate any rattling noise due to relative movement between these otherwise independent components. The lower spring 52 while providing a constant pressure against the ejector 30 through the mass 60 ensures that these components do not rattle against the tongue 2. The sides of the ejector 30 by extending well beyond the frame 12 enables these two components to be secured in a single-piece frame 12 which has a pair of elongated horizontal slots 31 which allows the ejector 30 to move in a horizontal direction only. Upon assembly, the ejector 30 is placed in the slots 31 of the frame and the mass 60 is positioned into the large opening 19 of the frame 12, thereafter the ejector 30 accepts or receives the mass 60 in a U shaped opening 30B which slides into grooves 62 on the mass resulting in a secure attachment of these two parts. The vertical movement of the ejector 30 is eliminated by the fact that the ejector 30 extends through these slots 31 and is limited to horizontal movement fore and aft. This also helps reduce and eliminate a variety of noise generating issues.

The present invention while providing a single piece frame 12 having U shaped structure enables the buckle assembly 10 to be simplified in the number of components required to make this buckle assembly 10. The associated slots as illustrated enable the components to be attached to the vertical sides 6, 7 of the frame 12 providing a unique way in which the buckle assembly 10 can be responsive to latching and unlatching while providing the buckle assembly free from having premature unlatching of the tongue 2 during accelerations and decelerations.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described which will be within the full intended scope of the invention as defined by the following appended claims.

What is claimed is:

1. An improved seat belt buckle assembly for use with a tongue of a seat belt, the seat belt buckle assembly comprises:

a frame;

a latch attached to the frame and being moveable from a latched position to an unlatched position, a forward portion of the latch being configured to engage a portion of the tongue inserted into the frame as the latch moves into the latched position;

a moveable control lever positioned above the latch, the control lever being substantially U shaped, having a central portion with two lever arms extending from opposite ends of the central portion, the central portion of the control lever having a contact surface contacting an upper surface portion of the latch and a projecting tab extending from the central portion for receiving an upper spring;

a locking bar connected to the control lever being moveably in an L-shaped slot on vertical sides of the frame; wherein the latch is moved into engagement of the inserted tongue by an initial downward movement of the locking bar in the L-shaped slots followed by horizontal forward movement causing the control lever to pivot about the locking bar pushing the latch into a latched position;

the upper spring urging the control lever and locking bar to push the latch downwardly into the latched position;

an ejector slidably mounted in a bottom of the frame for ejecting the tongue moveable in a horizontal direction within the frame;

a mass moveable with the ejector;

a lower spring for biasing the ejector in an outward direction connected to the frame and the mass which compresses relative to the frame;

a release button slidably mounted onto the frame which moves the locking bar in the L-shaped slots unlatches the latch when depressed allowing the ejector and the mass to move forward ejecting the tongue from the buckle; and wherein the control lever has stop surfaces on each end of the lever arms that move downwardly as the locking bar moves into a vertical portion of the L-shaped slots allowing the latch to move in the unlatched position during normal use locking the latch and control lever in the unlatched position, but when the buckle assembly is latched and exposed to a rapid deceleration the mass slides compressing the lower spring into the frame moving the mass to occupy a space directly under the stop surfaces of the control lever arms of the control lever blocking downward movement and preventing the locking bar from leaving horizontal portions of the L-shaped slots preventing movement of the latch into the unlatched position.

2. The seat belt buckle assembly of claim 1 wherein the upper spring is compressible between a rear fixed bracket attached to the frame and the projecting tab of the control lever, wherein in the unlatched position the upper spring is compressed as the control lever rests on an upper surface of the latch when the locking bar is moved into the vertical portions of the L-shaped slot.

3. The seat belt buckle assembly of claim 2 wherein the upper spring is held in place at each forward and rear end, the rear end held by a cylindrical projection concentrically inside the upper spring and the forward end held by the projecting tab on the control lever eccentrically holding the upper spring extending inside an upper portion of the upper spring and providing a downward force on the control lever and latch to assist movement in the L-shaped slot upon tongue insertion while allowing the upper spring to bend along a non linear path.

4. The seat belt buckle assembly of claim 1 wherein the frame is a single piece construction having a U shaped cross sectional shape.

5. The seat belt buckle assembly of claim 1 wherein the mass is attached to the ejector, the ejector fits into a slot in the mass and extends into a pair of horizontal slots on the frame, one horizontal slot being on each vertical side of the frame, the ejector securing the mass in the frame limiting the mass to horizontal forward and rearward sliding movements.

6. An improved seat belt buckle assembly for use with a tongue of a seat belt, the seat belt buckle assembly comprises:

a frame;

a latch attached to the frame and being moveable from a latched position to an unlatched position, a forward portion of the latch being configured to engage a portion of the tongue inserted into the frame as the latch moves into the latched position;

a moveable control lever positioned above the latch, the control lever being substantially U shaped, having a central portion with two lever arms extending from opposite ends of the central portion, the central portion of the control lever having a contact surface contacting an upper surface portion of the latch and a projecting tab extending from the central portion for receiving an upper spring;

a locking bar connected to the control lever being moveably in an L-shaped slot on vertical sides of the frame; wherein the latch is moved into engagement of the inserted tongue by an initial downward movement of the locking bar in the L-shaped slots followed by horizontal forward movement causing the control lever to pivot about the locking bar pushing the latch into a latched position;

an ejector slidably mounted in a bottom of the frame for ejecting the tongue moveable in a horizontal direction within the frame;

a mass moveable with the ejector;

a lower spring for biasing the ejector in an outward direction connected to the frame and the mass which compresses relative to the frame;

a release button slidably mounted onto the frame which moves the locking bar in the L-shaped slots unlatches the latch when depressed allowing the ejector and the mass to move forward ejecting the tongue from the buckle;

the upper spring urging the control lever and locking bar to push the latch downwardly into the latched position; and wherein the upper spring is compressible between a rear fixed bracket attached to the frame and the projecting tab of the control lever, wherein in the unlatched position the upper spring is compressed as the control lever rests on an upper surface of the latch when the locking bar is moved into vertical portions of the L-shaped slot, the upper spring being held in place at each forward and rear end, the rear end held by a cylindrical projection concentrically inside the upper spring and the forward end held by the projecting tab on the control lever eccentrically holding the upper spring extending inside an upper portion of the upper spring and providing a downward force on the control lever and latch to assist movement in the L-shaped slot upon tongue insertion while allowing the upper spring to bend along a non linear path.

7. The seat belt buckle assembly of claim 6 wherein the frame is a single piece construction having a U shaped cross sectional shape.

8. The seat belt buckle assembly of claim 6 wherein the mass is attached to the ejector, the ejector fits into a slot in the mass and extends into a pair of horizontal slots on the frame, one horizontal slot being on each vertical side of the frame, the ejector securing the mass in the frame limiting the mass to horizontal forward and rearward sliding movements.

9. The seat belt buckle assembly of claim 6 wherein the control lever has stop surfaces on each end of the lever arms that move downwardly as the locking bar moves into the vertical portion of the L-shaped slots allowing the latch to move in the unlatched position during normal use locking the latch and control lever in the unlatched position, but when the buckle assembly is latched and exposed to a rapid deceleration the mass slides compressing the lower spring into the frame moving the mass to occupy space directly under the stop surfaces of the control lever arms of the control lever blocking downward movement and preventing the locking bar from leaving horizontal portions of the L-shaped slots preventing movement of the latch into the unlatched position.

10. An improved seat belt buckle assembly for use with a tongue of a seat belt, the seat belt buckle assembly comprises:

a frame;

a latch attached to the frame and being moveable from a latched position to an unlatched position, a forward portion of the latch being configured to engage a portion of the tongue inserted into the frame as the latch moves into the latched position;

a moveable control lever positioned above the latch, the control lever being substantially U shaped, having a central portion with two lever arms extending from opposite ends of the central portion, the central portion of the control lever having a contact surface contacting an upper surface portion of the latch and a projecting tab extending from the central portion for receiving an upper spring;

a locking bar connected to the control lever being moveably in an L-shaped slot on vertical sides of the frame; wherein the latch is moved into engagement of the inserted tongue by an initial downward movement of the locking bar in the L-shaped slots followed by horizontal forward movement causing the control lever to pivot about the locking bar pushing the latch into a latched position;

the upper spring urging the control lever and locking bar to push the latch downwardly into the latched position;

an ejector slidably mounted in a bottom of the frame for ejecting the tongue moveable in a horizontal direction within the frame;

a mass moveable with the ejector;

a lower spring for biasing the ejector in an outward direction connected to the frame and the mass which compresses relative to the frame;

a release button slidably mounted onto the frame which moves the locking bar in the L-shaped slots unlatches the latch when depressed allowing the ejector and the mass to move forward ejecting the tongue from the buckle; and wherein the mass is attached to the ejector, the ejector fits into a slot in the mass and extends into a pair of horizontal slots on the frame, one horizontal slot being on each vertical side of the frame, the ejector securing the mass in the frame limiting the mass to horizontal forward and rearward sliding movements.

11. The seat belt buckle assembly of claim 10 wherein the control lever has stop surfaces on each end of the lever arms that move downwardly as the locking bar moves into a vertical portions of the L-shaped slots allowing the latch to move in the unlatched position during normal use locking the latch and control lever in the unlatched position, but when the buckle assembly is latched and exposed to a rapid deceleration the mass slides compressing the lower spring into the frame moving the mass to occupy a space directly under the stop surfaces of the control lever arms of the control lever blocking downward movement and preventing the locking bar from leaving horizontal portions of the L-shaped slots preventing movement of the latch into the unlatched position.

12. The seat belt buckle assembly of claim 11 wherein the frame is a single piece construction having a U shaped cross sectional shape.

13. The seat belt buckle assembly of claim 10 wherein the upper spring is compressible between a rear fixed bracket attached to the frame and the projecting tab of the control lever, wherein in the unlatched position the upper spring is compressed as the control lever rests on an upper surface of the latch when the locking bar is moved into a vertical portions of the L-shaped slot.

14. The seat belt buckle assembly of claim 13 wherein the upper spring is held in place at each forward and rear end, the rear end held by a cylindrical projection concentrically inside the upper spring and the forward end held by the projecting tab on the control lever eccentrically holding the upper spring extending inside an upper portion of the upper spring and providing a downward force on the control lever and latch to assist movement in the L-shaped slot upon tongue insertion while allowing the upper spring to bend along a non linear path.

* * * * *